United States Patent [19]

Takatsuka

[11] Patent Number: 4,936,896

[45] Date of Patent: Jun. 26, 1990

[54] DEVICE FOR CONFIRMING WHETHER A LOCK IS LOCKED OR UNLOCKED

[75] Inventor: Jitsuho Takatsuka, Yokohama, Japan

[73] Assignee: Hiroshi Hasegawa, Tokyo, Japan

[21] Appl. No.: 286,124

[22] Filed: Dec. 19, 1988

[51] Int. Cl.[5] ..... E05B 41/00

[52] U.S. Cl. ..... 70/432; 70/408; 70/276; 70/413

[58] Field of Search ..... 70/408, 432, 413, 276

[56] References Cited

U.S. PATENT DOCUMENTS

| | | | |
|---|---|---|---|
| 2,746,745 | 5/1956 | Damon | 70/413 X |
| 3,579,183 | 5/1971 | Lipschutz . | |
| 3,602,020 | 8/1971 | Kajita | 70/413 X |
| 3,633,393 | 1/1972 | Hisatsune | 70/413 X |
| 3,782,147 | 1/1974 | Hallmann | 70/413 X |
| 3,837,195 | 9/1974 | Pelto | 70/413 X |
| 3,967,479 | 7/1976 | Vick | 70/413 X |
| 4,249,161 | 2/1981 | Mohnhaupt . | |
| 4,285,220 | 8/1981 | Kajita | 70/413 X |
| 4,432,218 | 2/1984 | Hoener | 70/432 X |
| 4,438,430 | 3/1984 | Young et al. . | |
| 4,440,011 | 4/1984 | Klein | 70/432 X |
| 4,603,563 | 8/1986 | Mochida et al. | 70/413 X |
| 4,631,943 | 12/1986 | Hoener | 70/432 X |

FOREIGN PATENT DOCUMENTS

| | | | |
|---|---|---|---|
| 2330014 | 1/1975 | Fed. Rep. of Germany | 70/413 |
| 50-143695 | 11/1975 | Japan . | |
| 50-144598 | 11/1975 | Japan . | |
| 50-149493 | 11/1975 | Japan . | |
| 50-116398 | 12/1975 | Japan . | |
| 51-28099 | 3/1976 | Japan . | |
| 51-51996 | 4/1976 | Japan . | |
| 51-66094 | 5/1976 | Japan . | |
| 51-80494 | 7/1976 | Japan . | |
| 53-17497 | 2/1978 | Japan . | |
| 59-188260 | 12/1984 | Japan . | |
| 61-47364 | 3/1986 | Japan . | |

*Primary Examiner*—Gary L. Smith
*Assistant Examiner*—Suzanne L. Dino
*Attorney, Agent, or Firm*—Wenderoth, Lind & Ponack

[57] ABSTRACT

A device for confirming whether a lock is locked or unlocked in which a display magnet consisting of a sheet- or plate-like permanent magnet is rotatably disposed within a key head. Two magnet pairs, each consisting of a first drive magnet, and a second drive magnet are located at angular positions, respectively, on the front end face of a cylinder lock at opposite sides, respectively, of an intermediate angular position within a range of rotation of a key for locking and unlocking the cylinder lock. The direction of magnetization of one magnet pair is opposite to that of the other magnet pair. In response to the rotation of the key for locking or unlocking the cylinder lock, one, and the other, magnet pair imparts magnetic forces through a pair of magnetic induction plates disposed within the key head to the display magnet from different directions so that when the cylinder lock is locked or unlocked, the display magnet is forced to rotate in one or other direction to a predetermined angular position and is securely maintained at this position by the attraction between the display magnet and the magnetic induction plates.

14 Claims, 2 Drawing Sheets

FIG. 7 A1
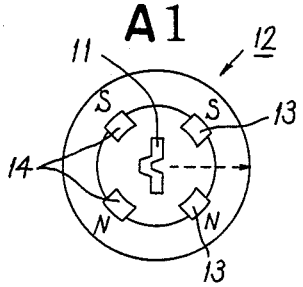
FIG. 7 A2
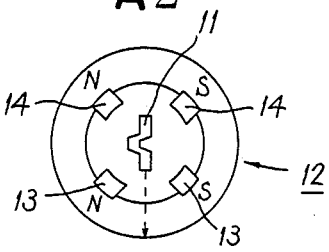
FIG. 7 A3
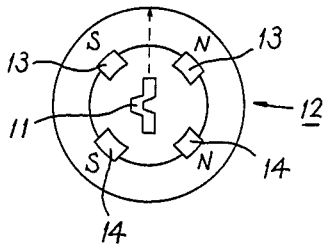
FIG. 7 B
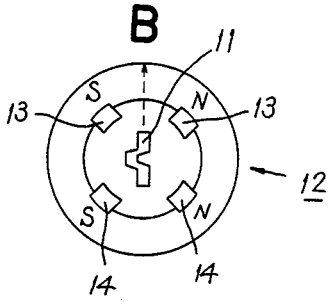
FIG. 8a
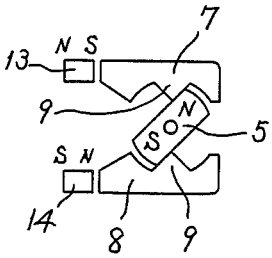
FIG. 8b
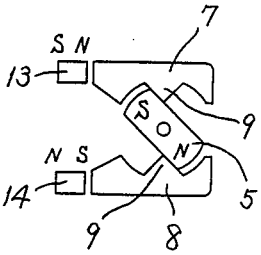
FIG. 9a
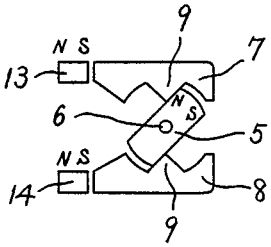
FIG. 9b
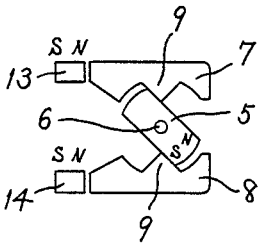
FIG. 10a
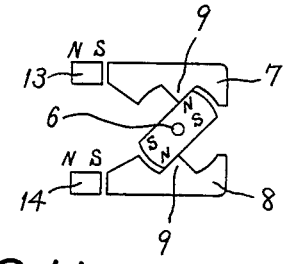
FIG. 10b
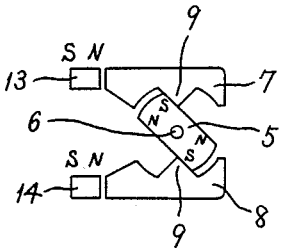
FIG. 11
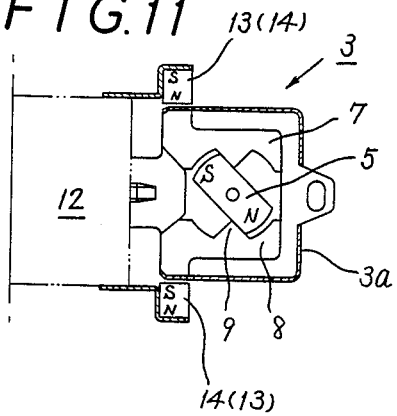

DEVICE FOR CONFIRMING WHETHER A LOCK IS LOCKED OR UNLOCKED

BACKGROUND OF THE INVENTION

The present invention relates to a device for confirming whether or not a cylinder lock is locked, and more particularly a device for confirming whether the cylinder lock is locked in which the ability to confirm whether the cylinder lock is locked or unlocked is imparted to a key for the cylinder lock.

For instance, it is impossible to confirm whether a cylinder lock is kept locked or unlocked by merely looking at a corresponding key when one is outside so that there are many persons who feel anxious and return to confirm whether the cylinder lock is locked or not. In order to substantially solve this problem a locking mechanism in which a corresponding key is incorporated with a display device for displaying whether the cylinder lock is locked or not is disclosed in, for instance, Japanese Laid-Open Utility Model Application No. 47364/1986. However, such a locking mechanism can be applied only to an extremely small number of types of cylinder locks and it is impossible in practice to incorporate a single-pore, double-throw switch, which is one of the most important component parts, into a head of the corresponding key, so it will take a long time before such a locking mechanism is used in practice.

Furthermore, a key holding mechanism for controlling the cylinder locks at various shops, offices and so on in a single building by an off-line operation has been devised and used. According to such a mechanism, the last person who leaves a shop or the like inserts a key into a cylinder of this mechanism to lock a cylinder lock and hold (store) the key. The next morning when the first person arrives at the shop, he/she meets a coded number by using a magnetic card or a ten-key keyboard to release and then pull out the key and then uses this key to open the cylinder lock. This mechanism is highly evaluated as the first non-caretaker or self-service control mechanism. However, from the standpoint of safety supervision of the building, this mechanism has a very serious blind point in that it cannot confirm whether a person who has left his/her shop last has completely locked the cylinder lock of his/her shop.

SUMMARY OF THE INVENTION

In view of the above, the primary object of the present invention is to provide a novel device for confirming whether a lock is locked or unlocked which is incorporated into a key of the lock itself.

For the sake of better understanding the present invention, the term "magnetically aligned" or "in magnetic alignment" is used to define the state where the axes of two magnets are substantially aligned with each other so that the exposed opposing poles of the magnets attract each other or repel each other.

To the above ends, the present invention is characterized in that a display magnet consisting of a sheet- or plate-like permanent magnet is rotatably disposed within a key head; two magnet pairs each consisting of a first drive magnet and a second drive magnet are located at angular positions, respectively, on the front end face of a cylinder lock at opposite sides, respectively, of an intermediate angular position within a range of rotation of the key for locking and unlocking the cylinder lock; the first drive magnet and the second drive magnet in each magnet pair are magnetized in opposite directions; in response to the rotation of the key for locking or unlocking the cylinder lock, one, and then the other, magnet pair imparts magnetic forces through a pair of magnetic induction plates disposed within the key head to the display magnet from different directions so that when the cylinder lock is locked or unlocked, the display magnet is forced to rotate in one or the other direction to a predetermined angular position and is securely maintained at this position by the attraction between the display magnet and the magnetic induction plates.

In the device with the above-described construction according to the present invention, when the cylinder lock is locked or unlocked, the display magnet is caused to rotate in one or the other direction so that the key itself has the capability of displaying whether the corresponding cylinder lock has been locked or unlocked. Thus, the above and other objects of the present invention can be attained.

The display magnet, at the angular position at which it is brought by its rotation under the influence of the magnetic forces, can be securely maintained so that no energy source for the data indicating whether the cylinder lock has been locked or unlocked is needed.

Furthermore, according to the present invention, the display magnet is rotated by the magnetic fluxes rather than mechanical means in contact with the display magnet. Therefore, the device can be made compact in size, light in weight and simple in construction, and highly reliable and dependable operation can be ensured for a long period of time.

BRIEF DESCRIPTION OF THE DRAWINGS

FIGS. 7A1–A3 and B are plan views of the drive magnets;

FIGS. 8A and B show the mode of operation of the first embodiment;

FIGS. 9A and B and 10A and B are views similar to FIG. 8, but illustrating a second and a third embodiment, respectively, of the present invention;

FIG. 11 is a cross sectional view similar to FIG. 6, but illustrating a fourth embodiment of the present invention.

DETAILED DESCRIPTION OF THE PREFERRED EMBODIMENTS

Figure 1:
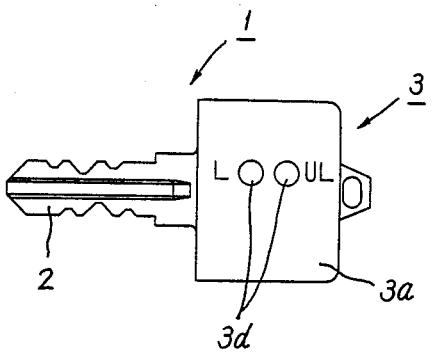
FIG. 1 is a side view of a key incorporating a first embodiment of the present invention.
Figure 2:
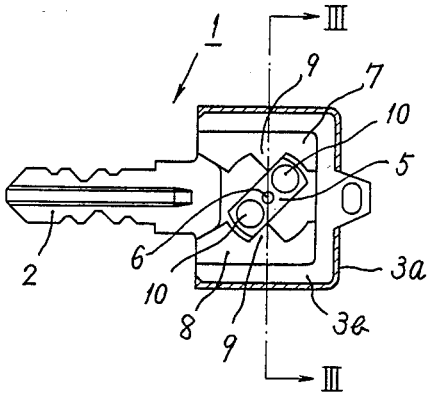
FIG. 2 is a partial sectional view of the key of FIG. 1.

Referring first to FIGS. 1 and 2, reference numeral 1 indicates a key of a cylinder lock which constitutes a first embodiment of the present invention. The shank 2 of the key 1, which is notched, is substantially similar in construction to those of conventional keys, but its head portion 3 has various means to be described below and may be covered with, for example, a plastic case 3*a*. It is to be noted that the shank portion 2 and a base plate 3b of the head 3, formed integral with the shank portion 2, are made of a non-magnetic material such as brass.

Figure 3:
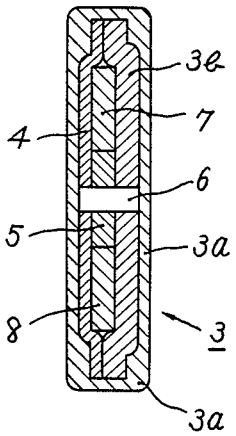
FIG. 3 is a cross sectional view, on an enlarged scale, taken along the line III—III of FIG. 2.
Figure 4:
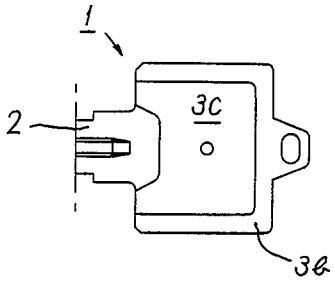
FIG. 4 is a side view of a base plate of a key head.

As best shown in FIGS. 3 and 4, the base plate 3b has a shallow recessed portion 3c (FIG. 4) formed by, for instance, a mechanical press. The connecting portion interconnecting the shank portion 2 and the base plate 3b and U-shaped ridge portion of the base plate 3b are not recessed.

A cover plate 4, which is also made of a nonmagnetic material, is fabricated to snugly mate with the surface of the base plate 3b formed with the shallow recess 3c. Plate 4 has a shallow recess (not shown) which is in symmetry and in opposing relationship with recess 3c, and is securely joined to the knob base plate 3b by, for instance, spot welding.

Thus, defined between the base plate 3b and the cover 4 within the head 3 of the key 1 is a space having a small dimension in the widthwise direction of the key head 3. This space communicates with the exterior through the openings defined between upper side of the connecting portion interconnecting between the shank 2 and the key head 3 and the upper ridge of the base plate 3b, and between the lower side of the connecting portion and the lower ridge of the base plate 3b, respectively.

As best shown in FIGS. 2 and 3, a display magnet 5, which comprises a permanent magnet plate with parallel sides, is rotatably carried by a pivot pin 6 which extends through the display magnet 5 at the mid-point between its ends and whose ends are pivoted to the base plate 3b and the cover plate 4, respectively, within the narrow elongated space. The display magnet 5 has a configuration obtained when a circular plate is cut off along two parallel chords which are spaced apart from the center thereof by the same distance in opposite directions and is magnetized, for instance, in the longitudinal (that is, the diametrical direction of the circular plate) direction thereof.

Furthermore, disposed within the narrow space in the head 3, first and a second magnetic induction plates 7 and 8 are disposed in such a way that they sandwich the display magnet 5 between them and they are substantially in parallel with the main body 2.

As best shown in FIG. 2, in the first embodiment, each magnetic induction plate 7 and 8 has an attraction projection 9 which is in the form of a saw tooth and extends from the mid-point of one side of each magnetic induction plate 7 and 8 in opposing relationship with the pivot pin 6. Thus, the magnetic induction plates 7 and 8 have a saw-tooth-waveform-like shape. The magnetic induction plates 7 and 8 are made of a hard or semi-hard sheet of a magnetic material and are substantially equal in thickness to that of the display magnet 5 (See FIG. 3).

The outer ends of the magnetic induction plates 7 and 8 are in opposed relationship with the upper and lower sides of the head 3. In the first embodiment, as best shown in FIG. 2, the side surfaces on the first and second magnetic induction plates 7 and 8 are exposed at both the upper and lower sides which are adjacent side of the shank 2, and sandwich the latter.

At least one surface of the display magnet 5 has light colored portions 10 (for instance, white colored portions) as shown in FIG. 2 and at least one side of the head case 3a is formed with a pair of peep holes 3d, each fitted with a transparent plate so that a key operator can observe from the exterior the displacement of the colored portions 10 of the display magnet 5 through the peep holes 3d. It is of course apparent that the cover plate 4 has two holes (not shown) in alignment with the peep holes 3d, respectively.

Figure 5:
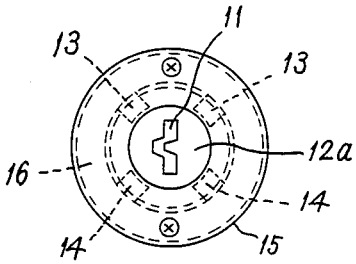
FIG. 5 is a front view of a cylinder lock illustrating drive magnets mounted thereon.
Figure 6:
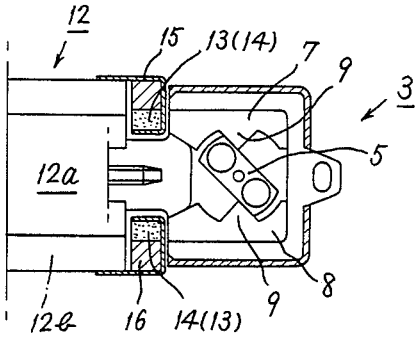
FIG. 6 is a sectional view of the key head and the drive magnets.

Two magnet pairs each consisting of a pair of diametrically opposed drive magnets 13 and 14 are arranged around an outer peripheral surface of a front end portion of an inner cylinder 12a of a cylinder lock 12 having a key hole 11 as shown in FIGS. 5 and 6.

In the first embodiment, the drive magnets 13 and 14 are securely bonded together with spacer rings 16 in a groove, substantially L-shaped in cross section, of a circular holder 15 fitted over the front end of an outer cylinder 12b of the cylinder lock. The holder 15 is securely attached to the front end surface of the outer cylinder 12b. It is to be noted that the holder 15 is also made of a non-magnetic material. It is of course apparent that arcuate spacers (not shown) made of, for instance, a plastic may be fitted into the space between the adjacent drive magnets 13 and 14 in the annular groove of the holder 15.

As best shown in FIG. 6, the position of each drive magnet 13 and 14 in the radial and axial directions of the cylinder lock is so selected that when the key 1 is inserted into the key hole 11 until the stepped portion of the key 1 is brought into contact with the front end surface of the inner cylinder 12a, the side of the magnetic induction plates in the head 3 may be brought into proximity with the drive magnets through the wall of the holder 15.

As shown in FIG. 15, first and second drive magnets 13 and 14 are positioned substantially in diametrically opposed relationship with each other and in symmetrical relationship with respect to the axis of the inner cylinder 12a of the cylinder lock in such a way that they can be aligned with their corresponding magnetic induction plates 7 and 8 during the locking or unlocking operation, as best shown in FIG. 6.

Furthermore, the two magnet pairs are equiangularly positioned in the circumferential direction of the cylinder lock 12 in such a way that the first and second drive magnets 13 and 14 in each pair are located on the opposite sides of an intermediate angular position between an angular position of the key 1 at which the lock is locked and an annular position at which the cylinder lock is unlocked (to be referred to as "the intermediate angular position" hereinafter in this specification).

When the intermediate angular position is further defined as described below, the understanding of various methods of operating the key of the cylinder lock are essential for the sake of better understanding the present invention so that first the key operation methods will be described.

The methods for operating conventional cylinder locks may be generally divided into two types A and B.

In the case of the method A, a user inserts a key into a key hole of a cylinder lock and turns it through a predetermined angle in the clockwise direction or counterclockwise direction and pulls it out of the key hole at the angular position thus determined. In the case of the method B, a user inserts into a key hole of a cylinder lock, turns it through a predetermined angle usually less than 180°, in the clockwise or counterclockwise direction and then turns it in the opposite directions; that is, in the counterclockwise direction or clockwise direction and pulls it out of the key hole at the position at which the key was inserted into the key hole. In this specification, the cylinder locks which are operated by the method A are referred to as "A" type while those which are operated by the method B is referred to as "B" type.

When a cylinder lock is mounted on a door and when a key is inserted into the key hole and is turned, for instance, in the clockwise direction (in the case of the B type cylinder locks, the going clockwise direction) so that the lock is, for instance, locked, the direction in which the cylinder lock is unlocked is uniquely determined as the counterclockwise direction. In the cases of the A type cylinder locks, the key is generally rotated through 180°, 360° and 720° to lock or unlock the lock. Therefore, in this specification cylinder locks in which the key must be rotated through 180° are referred to as the A1 type, those in which the key must be rotated through 360° are referred as the A2 type and those in which the key must be rotated through 720° are referred to as the A3 type. There exist, of course, cylinder locks in which the key must be rotated in the counterclockwise direction to lock the lock, but for the sake of simple understand of the present invention, it is assumed that the cylinder lock is locked, when the key is rotated in the clockwise direction.

Therefore, the above-mentioned intermediate angular position is defined as "one-half of the angle of accumulated rotations of the inner cylinder 12*a* required for locking or unlocking the cylinder lock. In the first embodiment, the direction of rotation for locking is defined as a reference direction and the rotation in the clockwise direction is called the positive direction while the rotation in the counterclockwise direction is the negative direction.

It follows therefore that the intermediate angular positions of the above-described A1, A2, A3 and B types become 90°, 180°, 0° (360°) and 0°, respectively, and, in terms of a watch dial, 3, 6, 12 and 12 o'clock, respectively.

The drive magnets are magnetized in the axial direction of the cylinder lock 12 and the direction of magnetization of the first and second drive magnets 13 and 14 of one pair are opposite to the direction of magnetization of those in the other pair. In the cases of the above-mentioned four operation types, the drive magnets 13 and 14 are magnetized as shown in FIG. 7, in which the dotted lines indicate the intermediate angular positions, respectively, of A1, A2, A3 and B types.

When the display magnet 5 is magnetized in the longitudinal direction as described above, the directions of magnetization of the first and second drive magnets 13 and 14 in one pair are opposite as shown in FIG. 8.

Next, the mode of operation of the first embodiment with the above-described construction will be described with reference to the A-1 type key operation.

In the case of the A-1 type cylinder lock shown at the upper left portion in FIG. 7, it is assumed that when the key hole 11 is in the vertical position as shown, the cylinder lock is defined as at the unlocked angular position and that in order to lock the cylinder lock, the shank 2 (See FIGS. 1 and 2) is inserted into the key hole 11 and then rotated in the clockwise direction. It is further assumed that when the key 1 is inserted into the key hole 11 at the unclocked position, the first magnetic induction plate 7 within the knob portion 3 of the key 1 is located at an upper position.

When the key is inserted into the key hole and then rotated through about 45° in the clockwise direction, as shown in FIG. 8*a*, the first drive magnet 13, which is magnetized so that the front end surface near the head portion of the key becomes the S-pole, is angularly aligned with one end of the first magnetic induction plate 7. In a like manner, the second drive magnet 14, which is so magnetized that the front end face thereof becomes the N-pole, is also angularly aligned with one end of the second magnet induction plate 8. Then magnetic flux from the drive magnets 13 and 14 then passes through the magnetic induction plate 7 and 8 with a low degree of magnetic resistance so that the S-pole is produced in the first magnetic induction plate 7 while the N-pole is produced in the second magnetic induction plate 8. As a result, regardless of the position of the display magnet 5, its N-pole is attracted to the inclined surface of the attraction projection 9 of the first magnetic induction plate 7 while the S-pole is attracted by the inclined surface of the attraction projection 9 of the second magnetic induction plate 8 so that the display magnet 5 assumes an annular position as shown in FIG. 8*a*.

When the knob 3 of the key 1 is further rotated in the clockwise direction, the magnetic induction plate 7 is out of angular alignment with the drive magnet 13, but there exists no external magnetic force to release the magnetic induction plates 7 and 8, (which are made of a magnetic material). The display magnet 5 is a permanent magnet so that the state in the knob portion of the key can be maintained in a stable manner as shown in FIG. 8*a*.

When the head portion 3 of the key 1 is further rotated in the clockwise direction beyond the intermediate angular position indicated by the dotted line, the first drive magnet 13, which is so magnetized that its front end face becomes the N-pole, is angularly aligned with one end of the first magnetic induction plate 7 while the second drive magnet 14, which is so magnetized that its front end face becomes the S-pole, is also angularly aligned with one end of the second magnetic induction plate 8. That is, the polarities of the magnetic induction plates 7 and 8 in the knob portion 3 of the key 1 are reversed.

The first magnetic induction plate 7 then imparts a magnetic repulsive force to the N-pole of the display magnet 5 while attracting the S-pole of display magnet 5. On the other side, the N-pole of the display magnet 5 receives the magnetic attractive force from the second magnetic induction plate 8 while it repels the S-pole of display magnet 5. Therefore, due to the rotation moment produced by these magnetic forces, the display magnet 5 is caused to rotate through 90° in the clockwise direction so that, as shown in FIG. 8*b*, the S-pole of the display magnet 5 is attracted by the inclined surface of the attraction projection 9 of the first magnetic induction plate 7 while the N-pole of the display magnet 5 is attracted by the inclined surface of the attraction projection 9 of the second magnetic induction plate 8. As a result, the colored portion 10 (See FIG. 2) which was viewed through the right peep hole 3*d* which is marked UL (unlock) seems to the viewer to be displaced to the left peep hole 3*d* which is marked L (lock).

When the cylinder lock is locked and the key 1 is pulled out of the key hole after the inner cylinder has been rotated through 180° in the clockwise direction (This state is not shown), the attracted state of the display magnet 5 within the key knob 3 remains unchanged. It follows therefore that when the key owner picks up his/her key after leaving his/her room, office or the like and checks whether the colored portion 10 can be viewed through the peep hole UL or L, he/she can confirm whether the cylinder lock is being left locked or unlocked.

In order to unlock the cylinder lock, the key 1 is inserted into the key hole 11 in such a way that the first magnetic induction plate 7 is located downwardly and is rotated through 180° in the counterclockwise direction. The cylinder lock is thus unlocked and simultaneously the attracted state of the display magnet 5 as shown in FIG. 8*b* changes to the attracted state of the display magnet 5 as shown in FIG. 8*a*. In this case, the colored portion (FIG. 2) is displaced below the peep hole 3*d* marked by UL and remains in the same position until the cylinder lock is locked again. It is to be noted here that the attracted states of the display magnet 5 shown in FIGS. 8*a* and 8*b*, respectively, can be maintained in a stable manner even when the key receives a high degree of impact, for instance, when it is dropped, because the center of gravity of the display magnet 5 is located on the pivot pin 6 carrying the display magnet 5 so that the rotation moment due to the acceleration imparted to the center of gravity is zero.

In the cases of the A2, A3 and B type cylinder locks shown in FIG. 7, the mode of operation of the display magnet 5 in the key knob 3 is substantially similar to that described above with reference to the A1 type cylinder lock, so that no further description shall be made in this specification.

FIG. 9 illustrate a second embodiment of the present invention in which the display magnet 5 is magnetized in the widthwise direction and the magnetized portion thereof is limited to one half of the portion extending from the pivot pin 6 to one end of the display magnet 5 in the lengthwise direction thereof. When the display magnet 5 is magnetized in the widthwise direction in the manner described above, the first and second drive magnets 13 and 14 are magnetized in the same direction as shown in FIG. 9. However, two magnet pairs which are located in the opposite directions with respect to the intermediate angular position are magnetized in the opposite directions as in the case of the first embodiment described above.

In the second embodiment, as is clear from FIG. 9, when the poles of the drive magnets 13 and 14 become angularly aligned with ends of the magnetic induction plates 7 and 8, respectively, the magnetized portion of the display magnet 5 is repelled by the repulsive force from one magnetic induction plate while being attracted by the attractive force from the other magnetic induction plate. Therefore due to the rotation moment produced by such magnetic forces, the display magnet 5 is rotated to a predetermined angular position and remains in this position in a stable manner because of the attraction between the magnetic induction plate 7 or 8 and the magnetized portion of the display magnet 5.

Except for the above-described construction, the second embodiment is substantially similar in construction to the first embodiment described above, so that no further detailed description shall be made in this specification.

FIG. 10 illustrate a third embodiment of the present invention which is substantially similar in construction to the second embodiment just described above with reference to FIG. 9, except that the display magnet 5 is magnetized in the widthwise direction thereof throughout the whole length thereof. The drive magnets are substantially similar in construction to the second embodiment shown in FIG. 9, but one half of the display magnet 5 extended from the pivoted point (the pivot pin 6) to one end thereof is magnetized in one direction while the second half of the display magnet 5 is magnetized in the opposite direction.

As is clear from the comparison of the third embodiment (FIG. 10) with the second embodiment (FIG. 9), when the cylinder lock is locked or unlocked, the rotation moment produced by the magnetic forces causes the display magnet 5 to rotate in a predetermined direction to a predetermined angular position, at which the display magnet 5 remains in a stable manner because of the attraction between the display magnet 5 and the magnetic induction plates 7 and 8. As compared with the second embodiment (FIG. 9), the third embodiment has the advantage that the magnetic forces act not only on one end but also on the other end of the display magnet 5, so that the operation of the latter can be more positively ensured.

It is to be noted here that the second and third embodiments are rather effective or advantageous for keys which have symmetrical upper and lower notches; that is, the so-called reversible keys. They are also advantageously used in locks of the type in which, when the lock is operated from within a room by a turn knob or the like, the angular position of the key is rotated by 180° relative to the angular position of the cylinder.

FIG. 11 illustrates a fourth embodiment of the present invention in which the end of the magnetic induction plates 7 and 8 which move toward the drive magnets 13 and 14 are arranged at the end of side edges of the key head 3, and therefore the drive magnets 13 and 14 are magnetized in the radial direction of the cylinder lock 12. The mode of operation, the effects and the features of the fourth embodiment are substantially similar to those of the first, second and third embodiments so that no further detailed description shall be made in this specification.

In FIG. 11, the display magnet 5 is illustrated as being magnetized in its lengthwise direction, but it is of course apparent that it may be magnetized in the widthwise direction.

It is to be understood that the present invention is not limited to the above-described embodiments and that various modifications may be effected without leaving the true spirit of the present invention.

For instance, two peep holes L and UL are shown in FIG. 1, but it suffices to provide only one peep hole marked L (Locked). In this case, whether the cylinder lock is locked or is unlocked can be confirmed by whether or not the colored portion 10 can be viewed through the peep hole 3*d* marked by L.

So far the preferred embodiments of the present invention have been described in conjunction with so-called disk tumbler locks, but it is to be understood that the present invention may be equally applied to cylinder locks of all types such as pin tumber locks, magnetic tumber locks, so-called ABLOY locks, ACE locks and so on.

So far it has been described that single magnets are arranged as the drive magnets, but it is to be understood that suitable angular portions of a ring-shaped plastic magnet may be locally magnetized in accordance with the pattern of the arrangement of the drive magnets described above so that mass production may be much facilitated.

When one set consisting of a cylinder and a key is commercially available, the direction of rotation of the key for locking the lock is determined only after the lock has been installed. In this case, at the installation site, an arbitary change must be made. In this respect, the abovementioned integral type drive magnets are very advantageous because the desired object can be attained by rotating the drive magnets about the axis of symmetry as a center or by turning the integral type drive magnets inside out.

It is to be understood that the projections on both sides of the attraction projection 9 extended from the side edge of the magnetic induction plate will not constitute the present invention.

What is claimed is:

1. A device for confirming whether a lock is locked or unlocked, comprising:

a key having a longitudinal axis and a head, said head including a permanent magnet pivotably mounted in said head, and at least one induction plate mounted in said head, said induction plate having an abutment portion disposed within the path of rotation of said permanent magnet;

a lock capable of being locked and unlocked by rotation of said key about said longitudinal axis within said lock, said lock having a front face;

at least one first and at least one second driving magnet connected to said lock and disposed in spaced relation to each other proximate said front face, each said first driving magnet also being disposed in opposing relationship to a respective said second driving magnet about a reference line, the reference line being normal to the axis of rotation of said key within said lock; each said first driving magnet having a polarity opposite each said second driving magnet;

whereby when said at least one induction plate comes into proximity to an associated one of said driving magnets during the rotation of said key within said lock, the magnetic field of said associated one of said driving magnets, acting through said induction plate, attracts the appropriate pole of said permanent magnet into abutting relationship with said abutment portion of said induction plate.

2. A device as in claim 1, wherein said permanent magnet is elongated along a longitudinal axis thereof and is pivotably mounted about a pivot axis substantially normal to said longitudinal axis of said permanent magnet.

3. A device as in claim 2, wherein said pivot axis is substantially at the mid-point of said permanent magnet along said longitudinal axis of said permanent magnet.

4. A device as in claim 3, wherein longitudinally extreme ends of said permanent magnet are oppositely polarized.

5. A device as in claim 3, wherein longitudinally extreme ends of said permanent magnet are oppositely polarized in the direction normal to both said longitudinal axis of said permanent magnet and said pivot axis.

6. A device as in claim 3, wherein said at least one induction plate comprises two induction plates, said induction plates and said abutment portions being disposed in spaced opposing relation about said longitudinal axis of said key, and said pivot axis is normal to said longitudinal axis of said key.

7. A device as in claim 6, wherein each said abutment portion comprises a triangular projection, the apex of said projection extending towards said pivot axis.

8. A device as in claim 6, further comprising a case mounted over said head, said case covering said permanent magnet and a portion of said induction plates, and means for indicating the rotational position of said permanent magnet.

9. A device as in claim 8, wherein said indicating means comprises at least one hole extending through at least one side of said case to said permanent magnet, said hole being positioned adjacent said abutment portion of at least one of said induction plates, whereby said permanent magnet may be viewed through said hole when one longitudinal end of said permanent magnet abuts said abutment portion of said one of said induction plates.

10. A device as in claim 1, wherein said at least one induction plate comprises two induction plates, said induction plates and said abutment portions being disposed in spaced opposing relation about said longitudinal axis of said key.

11. A device as in claim 10, wherein each said abutment portion comprises a triangular projection, the apex of said projection extending towards said longitudinal axis.

12. A device as in claim 10, wherein said at least one first driving magnet comprises two first driving magnets, and said at least one second driving magnet comprises two second driving magnets.

13. A device as in claim 1, further comprising a case mounted over said head, said case covering said permanent magnet and a portion of said induction plates, and means for indicating the rotational position of said permanent magnet.

14. A device as in claim 12, wherein said indicating means comprises at least one hole extending through at least one side of said case to said permanent magnet, said hole being positioned adjacent said abutment portion of at least one of said induction plates, whereby said permanent magnet may be viewed through said hole when one longitudinal end of said permanent magnet abuts said abutment portion of said one of said induction plates.

* * * * *